US009140141B2

(12) United States Patent
Cao et al.

(10) Patent No.: US 9,140,141 B2
(45) Date of Patent: Sep. 22, 2015

(54) TURBINE ASSEMBLY AND METHOD FOR ASSEMBLING A TURBINE

(75) Inventors: Khoa Cao, Simpsonville, SC (US); Kenneth Damon Black, Travelers Rest, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 634 days.

(21) Appl. No.: 13/542,794

(22) Filed: Jul. 6, 2012

(65) Prior Publication Data

US 2014/0010646 A1 Jan. 9, 2014

(51) Int. Cl.
*F01D 25/26* (2006.01)
*F01D 25/24* (2006.01)

(52) U.S. Cl.
CPC ..... *F01D 25/243* (2013.01); *F05D 2230/60* (2013.01); *Y10T 29/49321* (2015.01)

(58) Field of Classification Search
CPC ..... F01D 25/243; F01D 25/24; F01D 25/00; F01D 25/28; F05D 2230/60; Y10T 29/49321; F16B 5/0233; F16B 43/001; F16B 37/065; F16B 31/04; F16B 41/002; F16B 5/02; F16B 5/0258
USPC ..... 403/408.1, 337, 369
See application file for complete search history.

(56) References Cited

U.S. PATENT DOCUMENTS

| | | | | |
|---|---|---|---|---|
| 3,803,793 | A | 4/1974 | Dahl | |
| 4,008,926 | A * | 2/1977 | Belperin | 384/428 |
| 4,289,060 | A * | 9/1981 | Emmett | 411/34 |
| 4,732,519 | A * | 3/1988 | Wagner | 411/337 |
| 4,975,008 | A * | 12/1990 | Wagner | 411/337 |
| 5,810,558 | A * | 9/1998 | Streeter | 415/213.1 |
| 5,871,205 | A | 2/1999 | Latham | |
| 5,871,319 | A * | 2/1999 | Schneider | 411/107 |
| 6,059,503 | A * | 5/2000 | Johnson | 411/353 |
| 7,198,465 | B1 * | 4/2007 | Ichiryu | 415/214.1 |
| 7,229,061 | B2 * | 6/2007 | Battig et al. | 248/677 |
| 7,971,833 | B2 * | 7/2011 | Utaki et al. | 248/49 |
| 2010/0278608 | A1 | 11/2010 | Toosky | |

* cited by examiner

*Primary Examiner* — Nathaniel Wiehe
*Assistant Examiner* — Eldon Brockman

(57) ABSTRACT

According to one aspect of the invention, a turbine assembly includes a frame coupled to a ground surface, a bearing housing supporting a rotor bearing and a sleeve assembly attached to the frame and the bearing housing. The sleeve assembly includes an outer sleeve with a first flange on a first end that is positioned in an opening in the bearing housing and a second end that abuts the shim, an inner sleeve positioned within a portion of the outer sleeve and a bolt positioned within the inner sleeve and threadably coupled to the frame, wherein the bolt compressively loads the inner sleeve thereby loading a portion of the outer sleeve at the second end between the inner sleeve and the frame and wherein a first gap dimension is substantially maintained between the first flange and bearing housing as the bolt is preloaded and coupled to the frame.

17 Claims, 2 Drawing Sheets

TURBINE ASSEMBLY AND METHOD FOR ASSEMBLING A TURBINE

BACKGROUND OF THE INVENTION

The subject matter disclosed herein relates to turbomachinery. More particularly, the subject matter relates to an apparatus for assembling a frame and bearing housing of a turbine.

In a turbine engine, a combustor converts a chemical energy of a fuel or an air-fuel mixture into thermal energy. The thermal energy is conveyed by a fluid, often compressed air from a compressor, to a turbine where the thermal energy is converted to mechanical energy. As part of the conversion process, hot gas is flowed over and through portions of the turbine. High temperatures along the hot gas path can heat turbine components, causing thermal expansion of certain components. Some components or parts may be exposed to more hot gas than other parts, thereby causing the parts to move relative to one another. Relative movement of components due to thermal expansion can cause stress and wear for the components. Further, dimensional variations of the components due to manufacturing can enhance stress experienced by the components. Accordingly, coupling of turbine engine components that allows for thermal expansion can reduce stress and improve component life.

BRIEF DESCRIPTION OF THE INVENTION

According to one aspect of the invention, a turbine assembly includes a frame coupled to a ground surface, a bearing housing supporting a rotor bearing and a sleeve assembly attached to the frame and the bearing housing. The sleeve assembly includes an outer sleeve with a first flange on a first end that is positioned in an opening in the bearing housing and a second end that abuts the shim, an inner sleeve positioned within a portion of the outer sleeve and a bolt positioned within the inner sleeve and threadably coupled to the frame, wherein the bolt compressively loads the inner sleeve thereby loading a portion of the outer sleeve at the second end between the inner sleeve and the frame and wherein a first gap dimension is substantially maintained between the first flange and bearing housing as the bolt is preloaded and coupled to the frame.

According to another aspect of the invention, a method for assembling a turbine includes coupling a frame to a ground surface, supporting a rotor bearing via a bearing housing and positioning a first flange on a first end of an outer sleeve in an opening in the bearing housing and positioning a second end of the outer sleeve to abut the frame. The method also includes positioning an inner sleeve within a portion of the outer sleeve and positioning a bolt within the inner sleeve and coupling the bolt to the frame via threads, wherein the bolt compressively loads the inner sleeve and loads a portion of the outer sleeve at the second end between the inner sleeve and the member thereby substantially maintaining a first gap dimension between the first flange and the bearing housing as the bolt is threaded into the frame.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
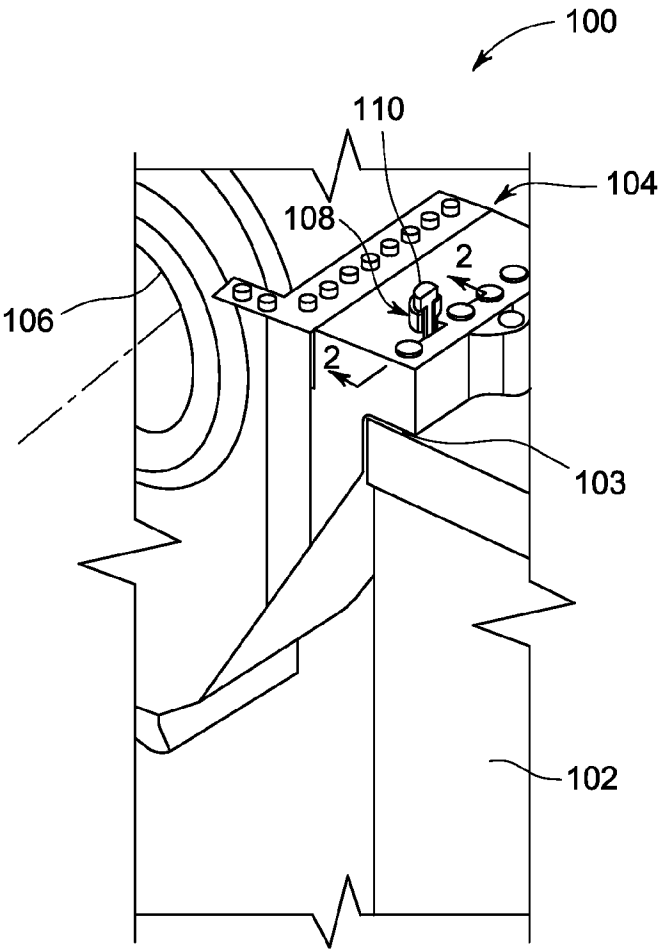
FIG. 1 is a perspective view of part of a turbine assembly according to an embodiment.

FIG. 1 is a perspective view of a portion of a turbine assembly 100 according to an embodiment. The turbine assembly 100 includes a member, such as a frame 102, coupled to a ground surface, such as a power plant floor. In an embodiment, the frame 102 is part of a flexible pedestal (also referred to as "rear standard") of a turbine system. In an embodiment, the frame 102 is part of an exhaust frame. The frame 102 includes a shim plate 103 positioned adjacent to or underneath the bearing housing 104 that supports a rotor bearing 106. The rotor bearing 106 is coupled to a rotor that turns as hot gas flows across rotor blades during turbine operation. As depicted, a sleeve assembly 108 and bolt 110 couple the bearing housing 104 to the frame 102. As discussed in detail below, the sleeve assembly 108 includes a plurality of sleeves configured to allow for thermal expansion of the turbine assembly 100 components while minimizing the associated stresses on the components. Further, the sleeve assembly 108 allows for manufacturing variations of the components while keeping desired specifications for a gap between the flange of the outer sleeve while the bolt 110 is loaded.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it can be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to any suitable machinery, including steam turbines. Accordingly, the discussion herein is directed to gas turbine embodiments, but may apply to other turbomachinery.

Figure 2:
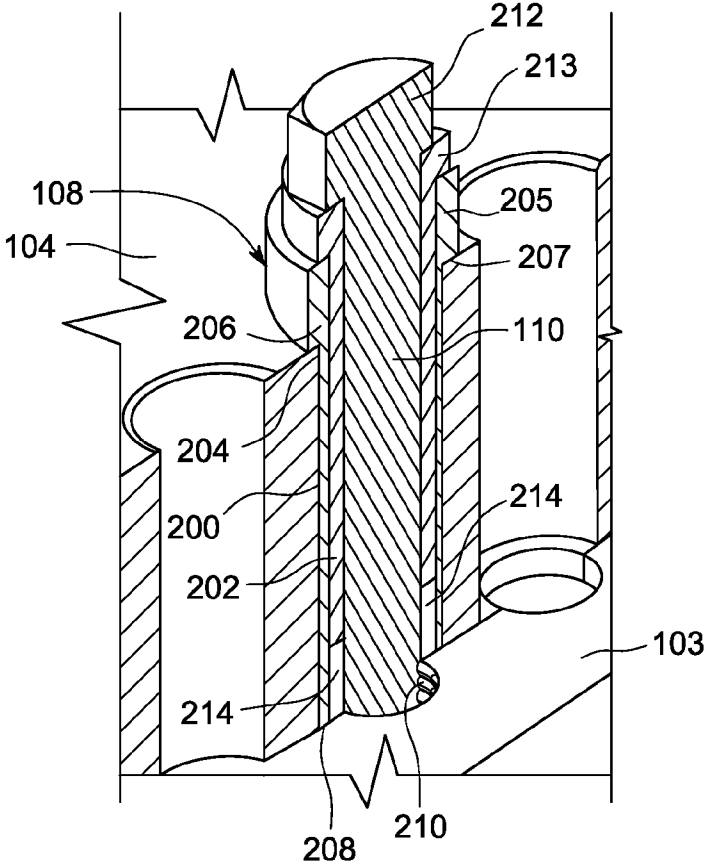
FIG. 2 is a detailed sectional view of a portion of the turbine assembly shown in FIG. 1.
Figure 3:
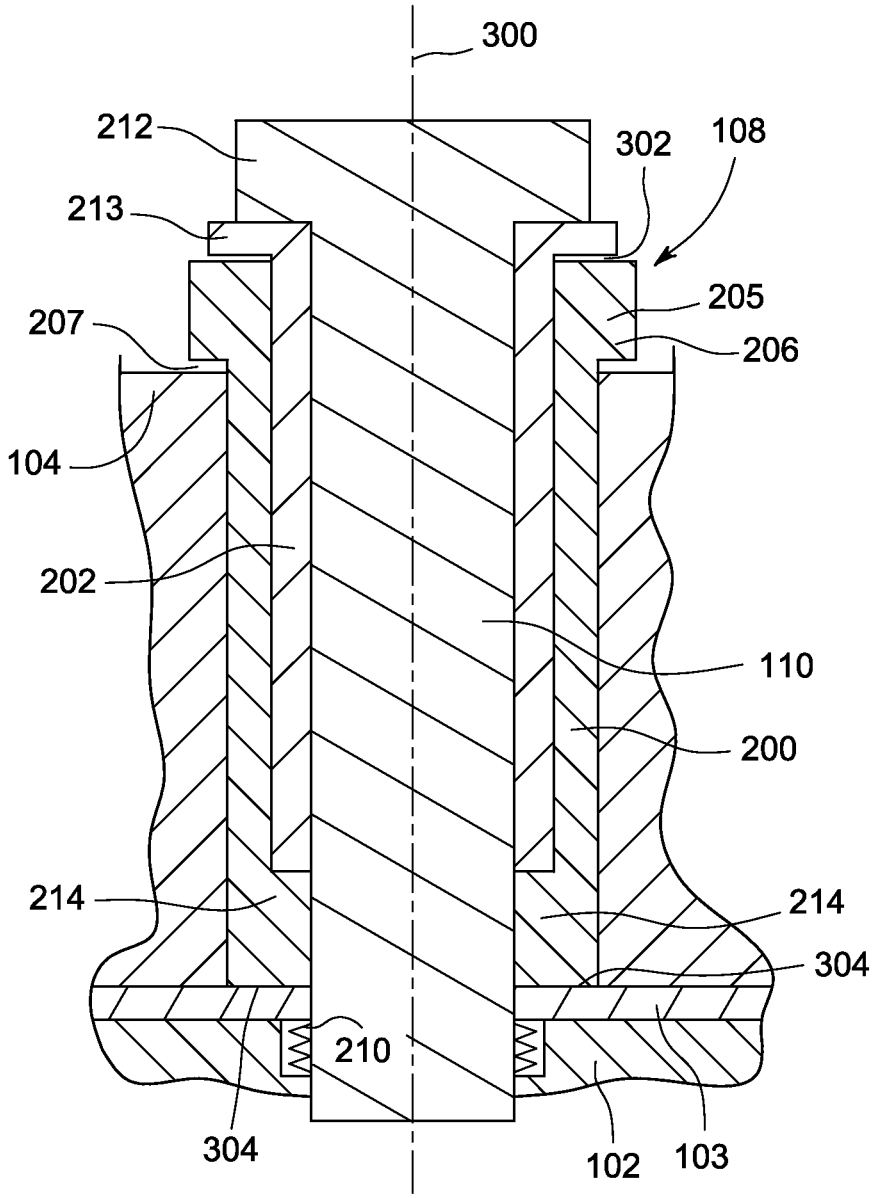
FIG. 3 is a schematic side sectional view of the portion of the turbine assembly shown in FIG. 2.

FIG. 2 is a detailed sectional view of a portion of the turbine assembly shown in FIG. 1. FIG. 3 is a schematic side sectional view of the portion shown in FIG. 2. The embodiment shows the bearing housing 104 coupled to or abutting the shim plate 103 by the sleeve assembly 108 and bolt 110. The sleeve assembly 108 includes an outer sleeve 200 and inner sleeve 202 positioned within the outer sleeve 200. The sleeve assembly 108 is positioned within a mounting hole of the bearing housing 104. In an embodiment, the sleeve assembly 108 is positioned in the bearing housing 104 without contacting the housing. A first end 205 of the outer sleeve 200 is positioned within an opening 204 in the bearing housing 104 where the first end 205 includes a flange 206. In one embodiment, the sleeve assembly 108 is configured to provide and substantially maintain a gap dimension 207 between the flange 206 and the bearing housing 204 when the bolt 110 is coupled and loaded to the frame 102 and/or shim plate 103. A second end 208 of the outer sleeve 200 abuts the shim plate 103, where a threaded coupling 210 between the frame 102 and the bolt 110 secures the bearing housing 104 to the shim plate 103 and frame 102. The bolt 110 is coupled to the frame 102 by rotating a head 212 of the bolt 110. In embodiments, the shim 103 compensates for manufacturing variations (e.g., surface irregularities) for assembly of the turbine section.

In an embodiment, the head 212 contacts a flange 213 of the inner sleeve 202, thereby compressing a compression region 214 of the outer sleeve 200. The compression region 214 is compressed in an axial direction, substantially parallel to an axis 300 of the bolt 110. By directing the compressive forces to the compression region 214, which is axially spaced apart from the first gap 207, the sleeve assembly 108 allows the first gap dimension 207 to be substantially maintained after the bolt/frame are loaded to a selected specification. Thus the arrangement enables variation in manufacturing tolerances and/or thermal expansion to occur without incurring or while reducing associated stress on the turbine assembly 100. Further, in an embodiment, the arrangement enables maintenance of a second gap dimension 302 between the flange 205 and flange 213. By substantially maintaining the first gap dimension 207 and/or second gap dimension 302 after loading, relative movement of the frame 102 and bearing housing 104 is permitted, thereby reducing stress experienced by the parts and extending part life. In addition, embodiments of the sleeve assembly 108 are configured to maintain the first gap dimension 207 and/or second gap dimension 302 to withstand a blade out condition, as discussed below. In an example, the bolt 110 compressively loads the inner sleeve 202 which in turn loads a portion of the outer sleeve 200 at the second end 208. In addition, as the bolt 110 is threaded into the frame 104 thereby loading the sleeve assembly 108 to the selected specification, the first gap dimension 207 is substantially maintained within a desired specification after the loading.

In one embodiment, variations in manufacturing process may lead to variations in contact surfaces 304 of the outer sleeve 205, frame 102 and shim plate 103, where the sleeve assembly 108 substantially maintains the first gap dimension 207 and/or second gap dimension 302 after loading, even with the occurrence of manufacturing variations. Further, in an embodiment, the first gap dimension 207 and/or second gap dimension 302 are also substantially maintained as the frame 102, bearing housing 104 and/or other turbine components thermally expand during turbine operation. In embodiments, the first gap dimension 207 and/or second gap dimension 302 may slightly change as the parts thermally expand but remain within a selected tolerance of the desired value. In an embodiment, the arrangement of the turbine assembly 100 and sleeve assembly 108 simplifies manufacturing by increasing tolerances while extending component life. In one embodiment, the bolt 110 and sleeve assembly 108 are formed using one or more strong and robust steel alloy. Accordingly, an embodiment of the sleeve assembly 108 design provides advantages on manufacturing tolerances and prevents adverse thermal mechanical responses.

In an exemplary application, the sleeve assembly 108 is configured to contain the bearing housing 104 in the event of a blade out condition. In a blade out event, fly-away blade(s) may cause the rotor to impact the bearing housing 104 which in turn may cause the bearing housing 104 to separate from the frame 102. The sleeve assembly 108 is configured to secure the rotor and bearing housing 104 to the frame as the rotor impacts the bearing housing. The arrangement of the sleeve assembly 108 and the first gap dimension 207 enables the rotor and bearing housing 104 to be retained in the blade out condition. Further, by substantially maintaining the first gap dimension 207, the arrangement enables relative movement of the bearing housing 104 and frame 102 while also being configured to withstand the blade out condition.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

a frame coupled to a ground surface;

a bearing housing supporting a rotor bearing; and a sleeve assembly attached to the frame and the bearing housing, the sleeve assembly comprising:

an outer sleeve with a first flange on a first end that is positioned in an opening in the bearing housing and a second end that abuts a shim;

an inner sleeve positioned within a portion of the outer sleeve; and a bolt positioned within the inner sleeve and threadably coupled to the frame, wherein the bolt compressively loads the inner sleeve thereby loading a portion of the outer sleeve at the second end between the inner sleeve and the frame and wherein a first gap dimension is substantially maintained between the first flange and the bearing housing as the bolt is preloaded and coupled to the frame.

2. The turbine assembly of claim 1, wherein a head of the bolt contacts a second flange of the inner sleeve positioned between the head and the first flange.

3. The turbine assembly of claim 2, wherein the bolt loads the second flange as the bolt is tightened into threads of a plate of the frame.

4. The turbine assembly of claim 2, wherein a second gap dimension is substantially maintained between the first flange and second flange as the bolt is preloaded.

5. The turbine assembly of claim 2, wherein the head of the bolt is not in contact with the first flange.

6. The turbine assembly of claim 1, wherein the first gap dimension enables movement of the bearing housing relative to the frame due to thermal expansion.

7. The turbine assembly of claim 1, wherein the first gap dimension allows for variations that occur during manufacturing of the outer sleeve and frame.

8. The turbine assembly of claim 1, wherein the first gap dimension between the first flange and bearing housing is substantially maintained within a desired specification as the bolt is preloaded to a specification.

9. A method for assembling a turbine, the method comprising:

coupling a frame to a ground surface;

supporting a rotor bearing via a bearing housing;

positioning a first flange on a first end of an outer sleeve in an opening in the bearing housing and positioning a second end of the outer sleeve to abut the shim;

positioning an inner sleeve within a portion of the outer sleeve; and positioning a bolt within the inner sleeve and coupling the bolt to the frame via threads, wherein the bolt compressively loads the inner sleeve and loads a portion of the outer sleeve at the second end between the inner sleeve and the frame thereby substantially maintaining a first gap dimension between the first flange and the bearing housing as the bolt is threaded into the frame.

10. The method of claim 9, wherein positioning the bolt within the inner sleeve comprises contacting a head of the bolt to a second flange of the inner sleeve positioned between the head and the first flange.

11. The method of claim 10, comprising loading the second flange as the bolt is tightened into threads of a plate of the frame.

12. The method of claim 10, comprising substantially maintaining a second gap dimension between the first flange and second flange as the bolt is preloaded.

13. The method of claim 10, wherein the head of the bolt is not in contact with the first flange.

14. The method of claim 9, wherein the first gap dimension enables movement of the bearing housing relative to the frame due to thermal expansion.

15. The method of claim 9, wherein the first gap dimension allows for variations that occur during manufacturing of the outer sleeve and frame.

16. The method of claim 9, wherein positioning the bolt within the inner sleeve comprises the bolt compressively loading the inner sleeve to a desired specification and substantially maintaining the first gap dimension as the bolt is threaded into the frame.

17. The method of claim 9, wherein the first gap dimension is substantially maintained as the bolt is preloaded by as the bolt is threaded into the frame.

* * * * *